United States Patent [19]

Weidmann

[11] 4,353,526

[45] Oct. 12, 1982

[54] ELECTRICAL DRIVE APPARATUS FOR A VERTICALLY DISPLACEABLE BLACKBOARD

[76] Inventor: Ulrich Weidmann, Industriestrasse 13, CH-8152 Glattbrugg, Switzerland

[21] Appl. No.: 199,513

[22] PCT Filed: Jul. 16, 1979

[86] PCT No.: PCT/CH79/00101

§ 371 Date: Apr. 10, 1980

§ 102(e) Date: Apr. 9, 1980

[87] PCT Pub. No.: WO80/00299

PCT Pub. Date: Mar. 6, 1980

[30] Foreign Application Priority Data

Aug. 10, 1978 [CH] Switzerland ..... 8518/78

[51] Int. Cl.[3] ..... B66D 1/12; B66D 1/20

[52] U.S. Cl. ..... 254/292; 254/343; 254/346; 254/362; 254/903

[58] Field of Search ..... 254/283–286, 254/289, 292, 293, 316, 343, 346, 350, 358, 359, 362, 365, 368, 903; 49/352, 360; 272/22; 160/331, 344, 193

[56] References Cited

U.S. PATENT DOCUMENTS

| | | | |
|---|---|---|---|
| 2,215,021 | 9/1940 | Vallen | 254/362 X |
| 3,117,767 | 1/1964 | McLean et al. | 160/331 X |
| 3,134,273 | 5/1964 | Wardlaw . | |
| 3,193,254 | 7/1965 | Minnick | 254/286 |
| 3,848,852 | 11/1974 | Therkildsen | 254/350 X |
| 3,921,925 | 11/1975 | Sarfati et al. | 242/47.01 X |
| 4,118,013 | 10/1978 | Christison et al. | 254/356 X |
| 4,171,594 | 10/1979 | Colanzi | 49/352 X |

FOREIGN PATENT DOCUMENTS

| | | | |
|---|---|---|---|
| 2612628 | 9/1977 | Fed. Rep. of Germany . | |
| 1082264 | 9/1967 | United Kingdom | 254/362 |

*Primary Examiner*—John M. Jillions
*Attorney, Agent, or Firm*—Karl F. Ross

[57] ABSTRACT

The invention relates to electrical drive apparatus for a vertically displaceable blackboard. In order to obtain synchronous operation of such drive apparatus either one motor, one shaft, or two motors connected by means of an electrical shaft were employed. The apparatus according to the invention operates with an electric motor which is combined with a worm drive, a drive sheave, and a slip coupling to a unit which is mounted at the top inside the guide beams of the blackboard, with the motor arranged vertically and having a hollow shaft through which the drive cable is guided. One such drive apparatus is mounted in each guide beam at its top, with simultaneous switching on and switching off without an electrical shaft.

8 Claims, 4 Drawing Figures

ELECTRICAL DRIVE APPARATUS FOR A VERTICALLY DISPLACEABLE BLACKBOARD

FIELD AND BACKGROUND OF THE INVENTION

The invention relates to an electrical drive for a vertically displaceable blackboard. In today's conventional very wide and relatively low blackboards such as are used in lecture halls there is the problem of canting of the board in its guides. In such wide blackboards, for example, a shaft mounted above the lateral guide beams guarantees synchronous operation of both of the cables or chains arranged on the sides of the blackboard. In Swiss Pat. No. 600,832 a drive system with two parallel connected hydraulic motors is described. In drives with electric motors use has been made of the possibility of a so-called electric shaft.

OBJECTS AND SUMMARY OF THE INVENTION

It is the object of this invention to make the drive with two simple electric motors without an electric shaft whereby in particular building into the lateral guide beams is possible. The invention attains these objects with a drive apparatus which is characterized in that an electric motor is combined with a worm drive, a drive sheave, and a slip coupling into a unit which is mountable in the hollow guide beams with the motor arranged vertically and having a hollow shaft through which the drive cable is guided.

It is advantageous if the slip coupling is so constituted that at least during assembly it can release the driven sheave. This allows the weight of the blackboard to be balanced exactly against the weight of the two counterweights.

BRIEF DESCRIPTION OF THE DRAWING

An embodiment of the invention is shown in the drawing.

SPECIFIC DESCRIPTION

Figure 1:
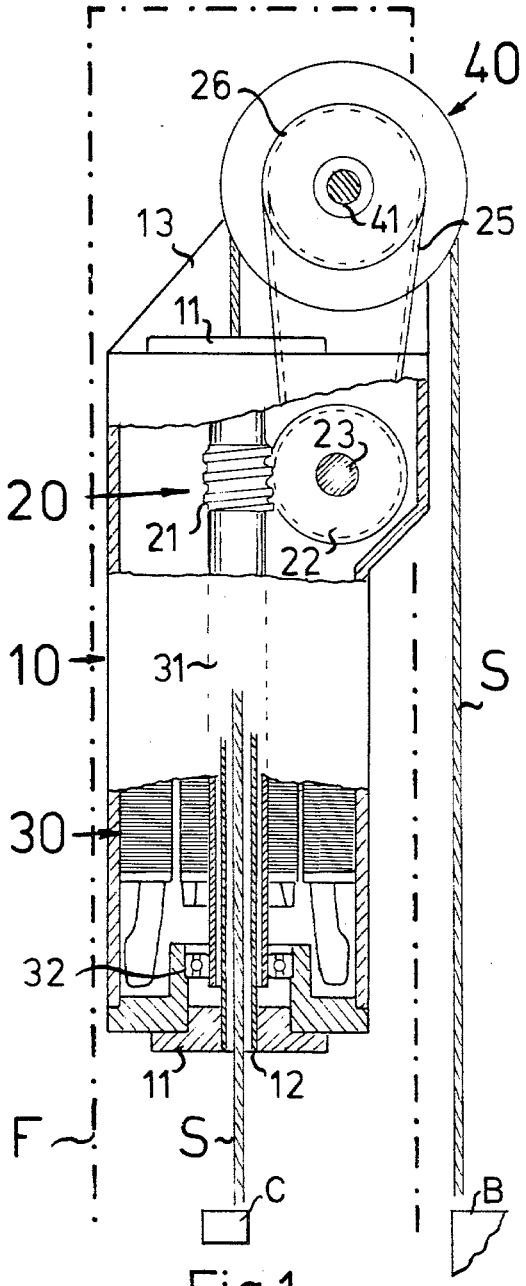
FIG. 1 shows the drive apparatus when built in, partly in section.
Figure 2:
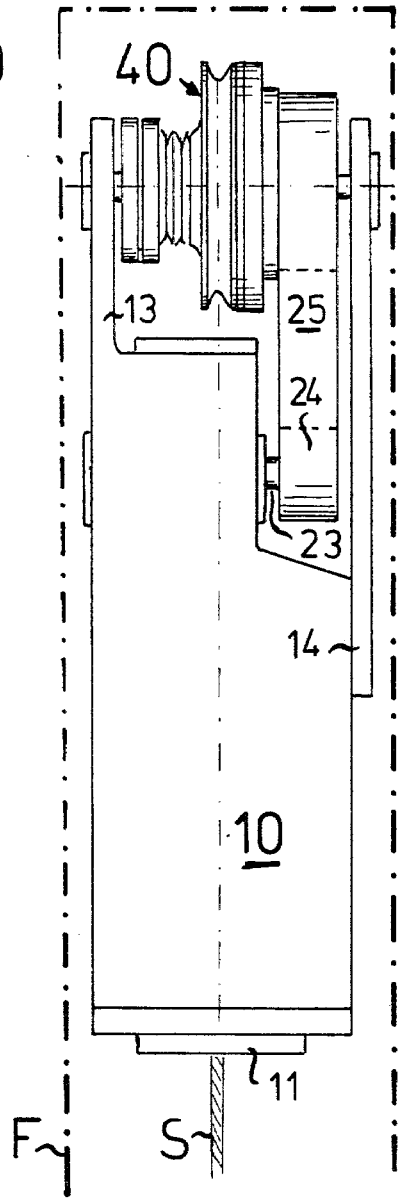
FIG. 2 shows the same apparatus in a side view.

In the drive apparatus shown in FIGS. 1 and 2 the guide beam F, in whose upper region the apparatus is mounted, is shown by thick dot-dash lines. The driven sheave 40 projects slightly from the beam and has at least in this region a recess.

The motor housing 10 is widened in its upper region to provide space for the worm drive 20 mounted in it. The worm 21 is mounted on the hollow shaft 31 of the electric motor 30. The worm gear 22 is fixed on a shaft 23 which projects from one side out of the housing 10.

The hollow shaft 31 of the motor 30 is rotatably mounted at its top and bottom in the housing in roller bearings 32. The cover caps 11 for these bearings each have a fixed (non-rotating) guide tube 12 concentric with the hollow shaft 31. A cable S is guided through the tube 12. An end of the cable is connected with a counterweight C mounted in the guide beam. The other end of the cable S is hooked on the blackboard B. The cable is to this end guided over the sheave 40.

The sheave 40 is driven by a toothed wheel 24 fixed on the shaft 23 with the help of a toothed belt 25. To this end a toothed wheel 26 is mounted on the shaft 41 on which the sheave 40 is mounted. The shaft 41 is rotatably mounted in the mounting plates 13 and 14 which are connected with the housing 10. The mounting plate 13 is fixed; the plate 14 is removable from the housing 10.

Figure 3:
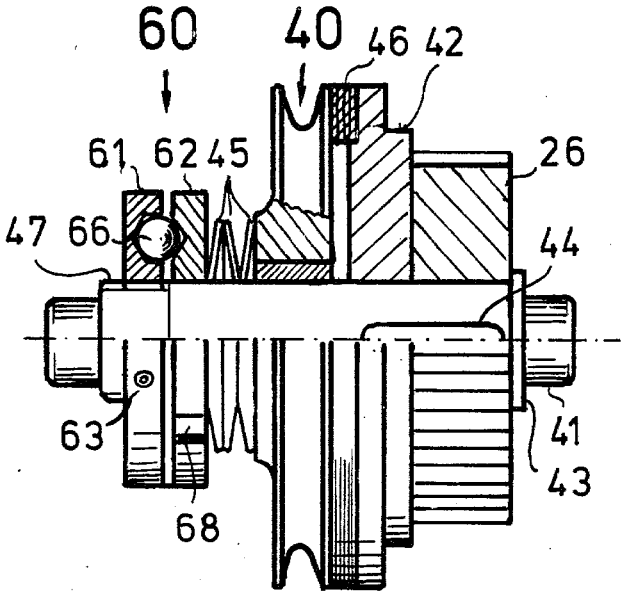
FIG. 3 shows a portion of the apparatus in enlarged scale.

The shaft 41 with the parts mounted on it is shown in FIG. 3 in larger scale. The toothed wheel 26 and a disc 42 provided with a brake pad 46 are fixed on the shaft 41. To this end there is a raised portion 43 and a key 44. The sheave 40 is rotatably and axially shiftably mounted on the shaft 41. In FIG. 3 the sheave 40 is provided with a self-lubricating bronze journal. It can also be provided with a needle bearing since the necessary axial shifting is only very slight.

The sheave 40 lies with its right side on the brake pad 46. On its left side are three spring washers 45 which are braced against a two-part counterpressure disc 60.

The counterpressure disc is made in two parts so that

1. In production the proper value of transmitted torque can be set,
2. During mounting the blackboard can be released for weight equalization, and
3. Finally again, the exact torque transmission can be set.

Figure 4:
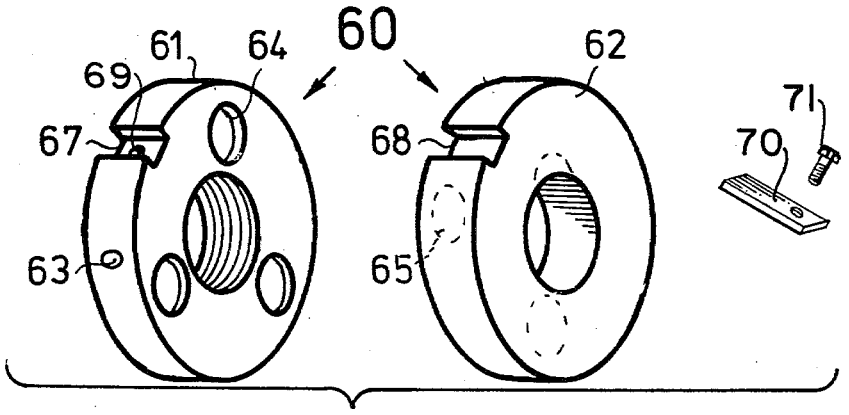
FIG. 4 shows two discs in perspective view.

The two-part counterpressure disc 60 has to this end a disc 61 fixed on the shaft 41 and a free disc 62 slightly axially shiftable on the shaft 41. The disc 61 is provided with an internal thread and is screwed on the thread 47 of the shaft 41 to set the pressure and is fixed in the set position by means of the setting screw 63 (see also FIG. 4).

The two discs 61 and 62 have opposite facing recesses 64 and 65 in each of which is a hardened ball 66. The recesses 64 in the disc 61 are deeper than those in the disc 62 so that the balls in the disc 61 are held at their largest diameter.

When the balls are engaged in both sides in the recesses 64 and 65 the spring washers are unloaded and the sheave 40 can rotate freely on the shaft 41. If the disc 62 is rotated relative to the disc 61 the balls 66 come into position adjacent the recesses 65 on the face of the disc 62. This increases the spacing between the discs 61 and 62 and loads the spring 65 so that the sheave 40 lies with corresponding pressure on the brake material 46 of the disc 42.

In this position the two grooves 67 and 68 of the discs 61 and 62 lie opposite each other and a key 70 locks them together. The key 70 is held in this position by a screw 71 threaded into a threaded bore 69 in the groove 67. This locked position corresponds as well to the position for setting the pressing pressure on manufacture as also to normal operating position. Only during mounting is the locking released so that the sheave can rotate freely.

Both guide columns F which flank the board are provided with such drives. The motor is preferably a three-phase motor with a short-circuit armature which can be connected by terminals either for right-hand or left-hand rotation It has been shown that one can make do without an electrical shaft. Naturally the blackboard is additionally provided with a parallel guide having cables and rollers. Slight nonsynchronous operation of the motors is compensated for by this parallel guiding in combination with the slip couplings.

I claim:

1. An electrical drive for a vertically displaceable board, said drive comprising:

a pair of upright hollow beams flanking said board;

an electric motor in each of said beams having an upright hollow shaft;

a sheave rotatable on each of said beams about a horizontal axis;

a counterweight in each of said beams;

transmission means in each of said beams between the respective motor and sheave and including a worm gear fixed on the respective hollow shaft, another gear meshing with the respective worm gear, and a slip coupling connected between the respective other gear and the respective sheave for rotation of same by the respective motor so long as the torque with which the respective sheave resists rotation by the respective motor does not exceed a predetermined limit established by said slip coupling; and respective cables spanned over said sheaves, passing vertically through the respective shafts and worm gears, and each having one end connected to said board and another end connected to the respective counterweight.

2. The drive defined in claim 1, further comprising respective horizontal axles on said beams for the respective sheaves and directly connected to the respective other gear, said slip couplings being carried on the respective axles.

3. The drive defined in claim 1 herein each sheave is at least limitedly axially and rotatable displaceable on the respective axle and each slip coupling includes:

a brake pad fixed on said axle and engageable with the respective sheave; and spring means urging said sheave and brake pad together with a predetermined force, wherein said limit is a function of said force.

4. The drive defined in claim 3 wherein each slip coupling further comprises:

a fixed disk rotatably secured on the respective axle;

a movable disk axially and rotably carried on the respective shaft adjacent the respective fixed disk, the disks of each coupling having respective confronting faces each formed with a plurality of angularly spaced and axially alignable recesses; and respective balls each partially received in the recess of one of said disks and in the confronting recess of the other respective disk, said spring means being compressed between said movable disk and said sheave.

5. The drive defined in claim 4 wherein said disks are displaceable between a mounting position with said recesses axially aligned and said disks relatively close and a normal position with said recesses axially misaligned and said disks relative far apart, whereby in said mounting position said spring means is less compressed than in said normal position.

6. The drive defined in claim 5, further comprising means including formations on said disks for retaining same in said normal position.

7. The drive defined in claim 6 wherein said means for retaining includes axially alignable grooves on said disks of each coupling and respective keys axially engageable between said disks of each coupling.

8. The drive defined in claim 5 wherein said fixed disk are each threaded onto the respective axles and axially displaceable by rotation relative thereto to change the compression of the respective spring means, said drive further comprising resectove set screws normally rotationally fixing said fixed disks on the respective axles.

* * * * *